US008618457B2

(12) United States Patent
Wright

(10) Patent No.: US 8,618,457 B2
(45) Date of Patent: Dec. 31, 2013

(54) DRIVE AND MEASUREMENT CIRCUIT FOR A PHOTOMULTIPLIER

(75) Inventor: Anthony George Wright, Amersham (GB)

(73) Assignee: ET Enterprises Limited, Uxbridge, Middlesex (GB)

( * ) Notice: Subject to any disclaimer, the term of this patent is extended or adjusted under 35 U.S.C. 154(b) by 683 days.

(21) Appl. No.: 12/321,162

(22) Filed: Jan. 16, 2009

(65) Prior Publication Data

US 2009/0230285 A1 Sep. 17, 2009

(30) Foreign Application Priority Data

Jan. 18, 2008 (GB) ..... 0800957.3

(51) Int. Cl.
*H01J 40/14* (2006.01)

(52) U.S. Cl.
USPC ..... 250/207; 250/214 VT; 313/532; 313/533

(58) Field of Classification Search
USPC ..... 250/207, 214 VT; 313/532, 533
See application file for complete search history.

(56) References Cited

U.S. PATENT DOCUMENTS 3,653,763 A 4/1972 Davies
5,525,794 A * 6/1996 Gibbons ..... 250/207
5,880,457 A * 3/1999 Tomiyama et al. ..... 250/207
6,316,930 B1 * 11/2001 Camin ..... 324/97
6,791,269 B1 * 9/2004 Popov ..... 315/12.1
7,005,625 B1 * 2/2006 Mitchell ..... 250/207
7,332,700 B2 * 2/2008 Ishimoto et al. ..... 250/207

FOREIGN PATENT DOCUMENTS

EP 1 014 098 6/2000
JP 2005276488 10/2005

OTHER PUBLICATIONS

Argiró, et al, *Monitoring DC Anode Current of a Grounded-Cathode Photomultiplier Tube*, Nuclear Instruments & Methods in Physics Research, Section A, vol. 435, No. 3, Oct. 11, 1999, pp. 484-489.
McMillan, *A Remote Monitor Circuit for Measuring Photomultiplier Anode Current at High Voltage*, Nuclear Instruments & Methods in Physics Research, Section A, vol. 562, Jun. 15, 2006, pp. 418-421.
Anonymous—*Photomultiplier Tubes, Basics and Applications [online], 2006, pp. 83-112, URL:http://sales.hamamatsu.com/assets/applications/ETD/pmt_handbook_complete.pdf.*

* cited by examiner

*Primary Examiner* — Georgia Y Epps
*Assistant Examiner* — Kevin Wyatt
(74) *Attorney, Agent, or Firm* — Hodgson Russ LLP

(57) ABSTRACT

A method of measuring an anode current in an electron-multiplier device having an anode, a cathode, dynodes and a voltage divider network for applying voltages to the dynodes, which method includes applying an HV positive voltage to the anode and intermediate voltages to the dynodes, the cathode being at or near circuit ground potential, conducting dynode currents through or in parallel to the voltage divider to a point substantially at cathode potential, and deriving from those currents a current representative of the anode current.

17 Claims, 5 Drawing Sheets

(Prior Art)

10
12
14
16
18
+V
$I_D + I_a + I_{DV}$
$R_{16}$
$R_{15}$
$R_{14}$
$R_{13}$
$R_{12}$
$R_{11}$
$R_6$
$R_5$
$R_4$
$R_3$
$R_2$
$R_1$
$V_0$
$I_{DV}$
$I_D$
$I_a$
$I_k$
$I_D + I_a$
$I_D + I_a - I_k$
$I_D+(I_{d2}+\ldots+I_{d10})$
$I_D+(I_{d8}+\ldots+I_{d10})$
$I_D+(I_{d9}+I_{d10})$
$I_D+I_{d10}$
$M_1$
$M_2$
$M_8$
$M_9$
$M_{10}$
(a)
(b)
$d_1$
$d_2$
$d_8$
$d_9$
$d_{10}$
$I_{d1}$
$I_{d2}$
$I_{d8}$
$I_{d9}$
$I_{d10}$
$I_a/\delta^{10}$
$I_a/\delta^9$
$I_a/\delta^8$
$I_a/\delta^3$
$I_a/\delta^2$
$I_a/\delta$

DRIVE AND MEASUREMENT CIRCUIT FOR A PHOTOMULTIPLIER

This application claims priority benefit of U.K. Patent Application No. 0800957.3 filed Jan. 18, 2008.

This invention relates to a measurement method and circuit for photomultipliers or other discrete-dynode electron-multiplier devices.

A photomultiplier is a vacuum-tube device which converts a light signal to be measured into an electric current at its input, the photocathode. The current is relatively small, typically of the order of pico-amps. This small current is amplified by a series of discrete dynodes forming an internal electron multiplier in the photomultiplier, by up to ten million times, to provide an output of the order of microamps at its output, the anode. Where the light input is slowly varying in time, e.g. with a period of the order of milliseconds or more, dc measurements are commonly made. Where the light input occurs in pulses down to the order of nanoseconds the output can be measured in terms of both count rate and charge by integrating the output current for a time appropriate to the duration of the light input. Also, at very low light levels, the output of the photomultiplier can be measured as a dc signal, or counted as a rate of single photoelectron events from the photocathode, amplified by the electron multiplier, at rates of up to 100 MHz.

The photomultiplier is operated by applying a high voltage (generally 1 to 3 KV) to the anode. The voltage is also applied via a voltage divider network to maintain the dynodes of the photomultiplier at successively higher intermediate voltages. The higher the overall voltage the higher is the amplification of the internal electron multiplier.

The photomultiplier is sensitive to external electric and magnetic fields, and to achieve the most stable operation it is desirable to operate the photocathode at, or near, ground potential. This eliminates electrostatic voltage differences between the photocathode and any housing around the photomultiplier, which is at ground potential for safe operation. Unstable operation of a photomultiplier can often be traced to voltage gradients between the photocathode and the environment. This instability can appear in short bursts as discharges across insulating materials and over the longer term through ion migration from the photocathode through the glass envelope of the photomultiplier.

However, if the cathode is grounded, the anode is necessarily at a positive high voltage, and the anode (output) signal must be capacitively coupled to measurement equipment, such as an oscilloscope or multi-channel analyser. Effective measurement of direct currents is thus difficult, and even pulsed signals are subject to distortion and a baseline shift due to the capacitive coupling. For effective dc measurement it is necessary that the anode be grounded and the cathode be at a negative high voltage, with the attendant stability problems noted above.

The present invention seeks to avoid these instability problems, whilst at the same time providing, at low potential, an output signal which is representative of the anode current and which can preserve both the dc and pulsed components.

In one aspect, the invention provides a method of measuring an anode current in an electron multiplier device having a cathode at or near circuit ground potential, an anode at a relatively high potential, and dynodes at successive intermediate potentials. The method entails measuring, substantially at ground potential, a current representative of the anode current and derived from currents flowing in the dynodes.

An embodiment provides a method of measuring an anode current in an electron-multiplier device having an anode, a cathode, dynodes and a voltage divider network for applying voltages to the dynodes, which method includes applying an HV positive voltage to the anode and intermediate voltages to the dynodes, the cathode being at or near circuit ground potential, conducting dynode currents through or in parallel to the voltage divider to a point substantially at cathode potential, and deriving from those currents a current representative of the anode current.

The method may comprise summing the dynode currents, optionally also a cathode current, and deriving the anode current from the summed currents. We show later that the anode current is equal to the sum of the dynode currents.

In one embodiment, what amounts to the anode signal is transmitted down a voltage divider (which provides the successive intermediate potentials to the dynodes) towards the photocathode, which is at ground potential. A standing voltage divider current, specifically that in an active string thereof, which is mixed in with this signal, is subtracted to yield a current equal to the anode current alone.

At least some of the dynode currents may be passed successively via transistors, which serve to interface the resistor string of the voltage divider with the dynodes. Although bipolar transistors or JFETs may be used, preferably these transistors are MOSFETs, and the dynode currents are passed through the source-drain paths thereof.

The remaining dynode currents, or indeed all of them, may be diverted around those transistors.

In another aspect, the invention provides a biasing and measurement circuit for an electron multiplier having a cathode, an anode and dynodes therebetween, the circuit comprising: means for maintaining the cathode at or near circuit ground potential, a means for connecting the anode to a relatively high positive potential, means (for example a voltage divider) for applying graduated intermediate voltages to the dynodes and means for measuring substantially at ground potential a current representative of the anode current and derived from currents flowing in the dynodes.

In another aspect, the invention provides a biasing and measurement circuit for an electron multiplier having a cathode, an anode and dynodes therebetween, the circuit comprising a maintainer to maintain the cathode at or near circuit ground potential, a connector to connect the anode to a relatively high positive potential, an applier to apply graduated intermediate voltages to the dynodes, and a measurer to measure substantially at ground potential a current representative of the anode current and derived from currents flowing in the dynodes.

The measurer may be configured to sum the dynode currents flowing in all of the dynodes and optionally also a cathode current.

There may be a subtractor to subtract from the summed dynode currents a concomitant standing current flowing in an active part of the voltage divider.

The subtractor may comprise an operational amplifier.

Preferably the operational amplifier may be provided with a feedback loop to its inverting input of impedance $R_2$, the non-inverting input being grounded via an impedance $R_1$ such that $I_D R_2 = I_{DV} R_1$ where $I_{DV}$ is the standing current through the resistor string of the voltage divider and $I_D$ is the standing current through the string of transistors.

There may be a diverter (for example a capacitor) to divert a current from at least one dynode around the voltage divider or other mechanism for applying graduated voltages.

Preferred embodiments of this invention take advantage of the fact that the entire anode signal current can be transmitted, stage by stage, via the dynodes down the voltage divider regardless of its particular make-up. The use of a JFET or MOSFET voltage divider (which has substantially zero gate current) minimises dissipation of the dynode signals as they progress down the divider towards the cathode. The divider consists of two parallel strings: a resistor chain which establishes the required biasing potentials and a series of FET devices which picks off these potentials. The anode signal is mixed in with the FET standing current and the method can provide a way of compensating for this standing current.

In the preferred embodiments, the anode signal is measured after transmission through the voltage divider network, as opposed to measuring it directly at the anode. However, access to the anode signal at high voltage is still available in the conventional way, and advantage is taken of this in one of the described embodiments. The measurement of dc signals, both pulsed and slowly varying, is done by transmitting the individual dynode signals, the sum of which comprise the anode signal, down the dc coupled divider string, whereupon the standing transistor string current is disentangled from the signal.

The use of an operational amplifier to remove the unwanted transistor string current is a preferred feature of the invention. The use of an active voltage divider, that is one containing, transistors is also a preferred feature to the invention.

The invention now will be described merely by way of example with reference to the accompanying drawings, wherein.

We start with an analysis of how voltage dividers work. The focus of the analysis is to reveal the means by which we may extract the anode signal after transformation to a low potential, thereby making dc measurements possible.

Figure 1:
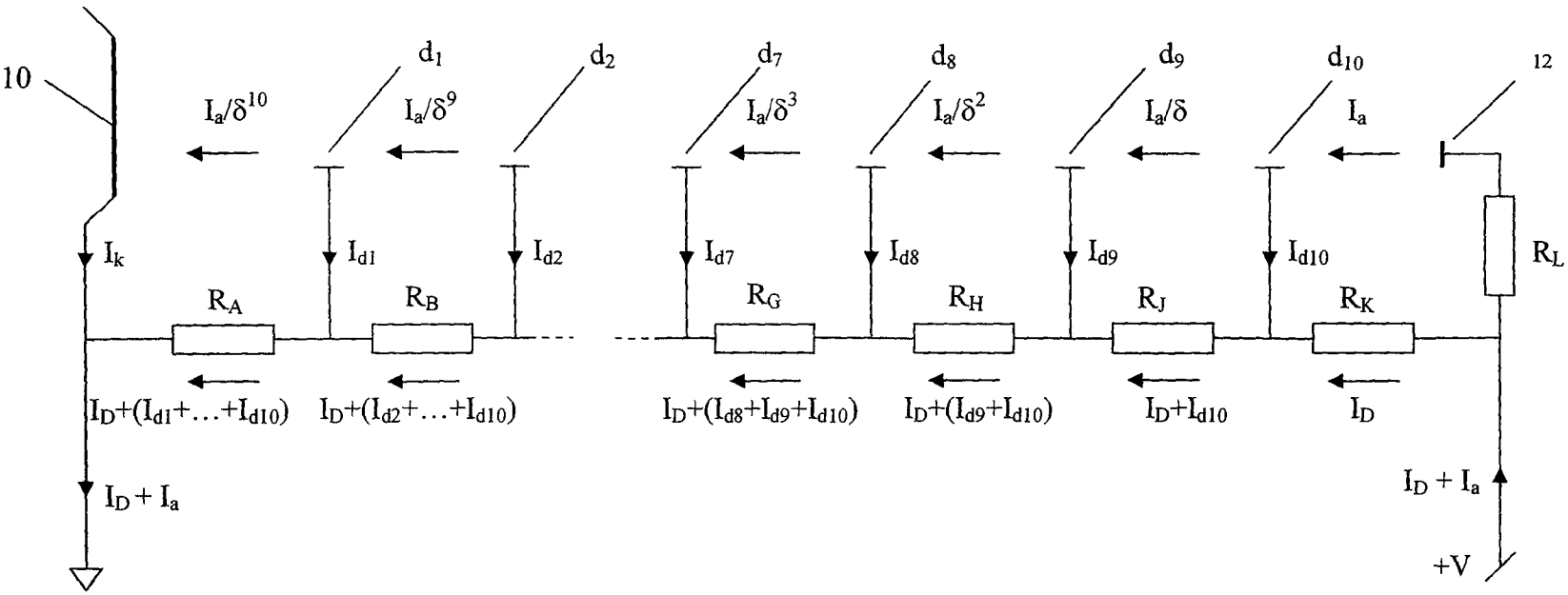
FIG. 1 shows symbolically a prior-art photomultiplier and associated circuitry.

Referring to FIG. 1, a photomultiplier (PMT) comprises a cathode 10, anode 12 and dynodes $d_1$ to $d_{10}$ all within a vacuum envelope. Multipliers may have between one and twenty or so dynodes: without loss of generality, ten dynodes have been assumed in this example. The cathode is held at circuit ground, and the anode at a high positive potential +V.

A passive voltage divider comprising resistor string $R_A$ to $R_K$ provides graduated potentials to the dynodes as known per se. Resistor $R_L$ is an anode load resistor.

FIG. 1 shows a 10 stage PMT but the following discussion is independent of the number of dynode stages and the HV polarity. Kirchhoff's law requires that the currents divide in the manner shown where $I_a$ is the anode (output signal) current flowing as a consequence of light input, which produces a photocathode current $I_k$. We can assume, without loss of generality, that all stages have common gain, δ.

FIG. 1 shows the currents that flow in every element of the circuit, and in particular how the incremental dynode currents combine. The current flowing in the tenth dynode is for example $I_a-I_a/\delta$. The currents $I_a/\delta_1, \ldots, I_a/\delta^n$ are internal to the photomultiplier and are not accessible, but all others are. In the absence of anode current, the same current $I_D=I_{D0}$ flows through every resistor. It is clear, however, that the act of drawing signal changes every current element in the divider string, in the manner shown in FIG. 1. This in turn causes the gain of the photomultiplier to increase, as is known per se. The explanation for this is as follows: the voltage across every resistor except $R_K$ increases with $I_a$ and since the anode voltage is fixed, the voltage across $R_K$ must decrease. The role of $R_K$ is to provide a collecting voltage for the charge released from the last dynode; there is no amplification between $d_{10}$ and the anode. The voltage drop across $R_K$ distributes itself over all the other resistors in the string and the effect is similar to that of increasing the anode voltage.

It can be shown, if all the resistors $R_A$ to $R_K$ are of the same value R, that $$I_D = \frac{V}{11R} - \frac{I_a}{11}[10 - 1/(\delta - 1)] \tag{1}$$

and by ignoring the term containing δ, we arrive at $$I_D \sim I_{D0} - \frac{10}{11} I_a \tag{2}$$

where $I_{D0}$ is the standing current in the divider when $I_a=0$

The current flowing out of the power supply, $I_{HV}$, is given by $$I_{HV} = I_D + I_a = I_{D0} + \frac{I_a}{11}\delta/(\delta - 1) \tag{3}$$

Equation (2) quantifies the explanation given above for the increase in gain with $I_a$, but we have identified that equation (3) points to something of greater significance, which will be utilized later.

It has been shown above that purely resistive voltage dividers are incapable of providing constant gain with changing anode current. Acceptable performance can be obtained by ensuring that $I_a$ is always much less than $I_{D0}$, typically by choosing $I_{D0}>100.I_a$ (max). There is a limit to $I_{D0}$ of about 1 mA, dictated by the power supply capability and also by the onset of heating effects. These considerations apply equally to dc and to pulsed signals, for which a mean anode current can always be assigned.

Figure 2:
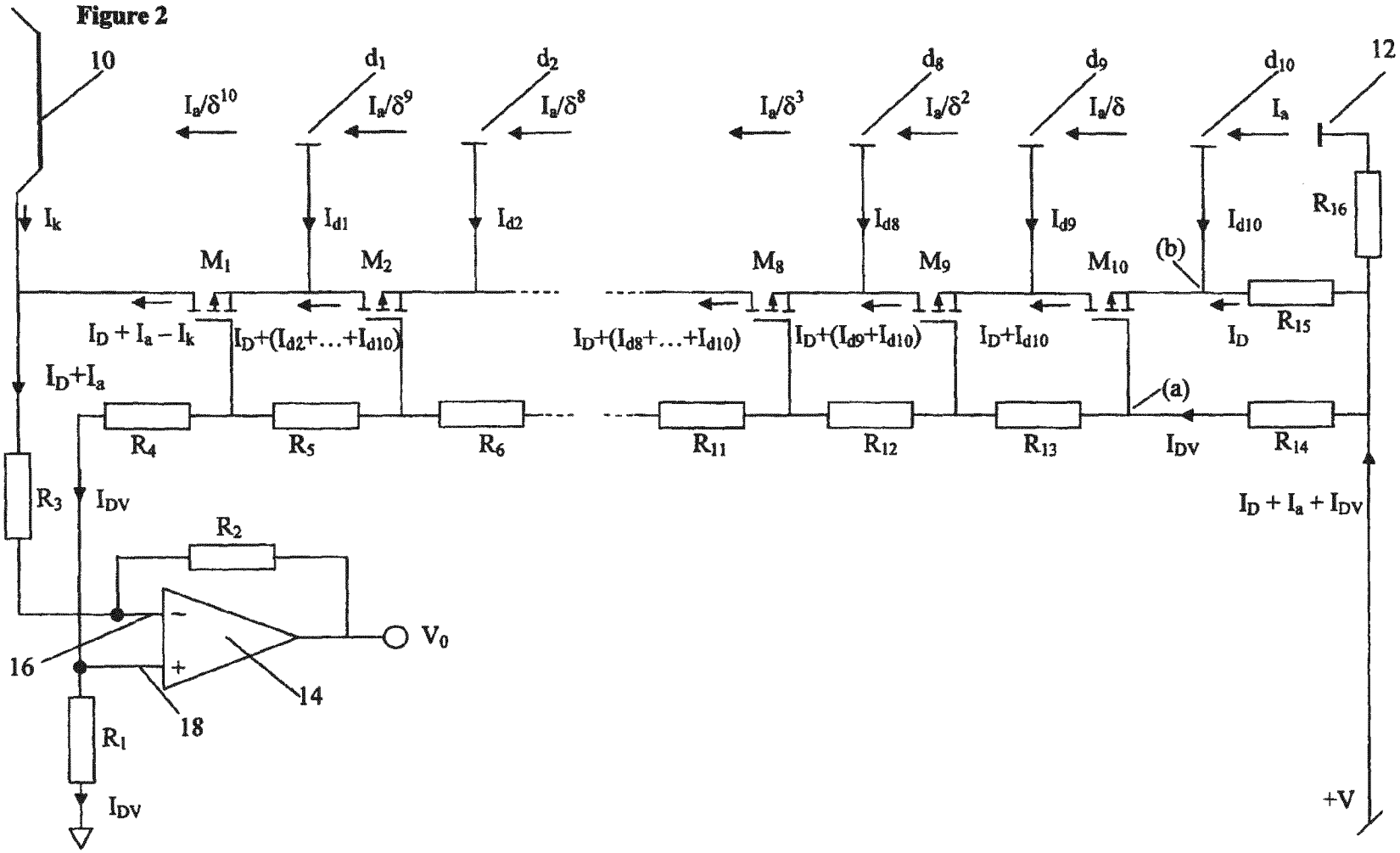
FIG. 2 shows symbolically a photomultiplier having a drive and measurement circuit according to the invention.

The use of zener diodes to stabilize the back-end dynode voltages is known as a means of improving gain stability. A more satisfactory method is to use a series of transistors connected in parallel to the resistor string. The base of each transistor is connected to the corresponding junction of the resistor string. The emitters are connected to the dynodes and ensure fixed inter-dynode voltages through their emitter follower action. The improvement in gain stability is a factor of $h_{fe}$ (the transistor current gain) times that of the unstabilized resistor divider of the same total resistance. $I_D$ therefore still changes with anode current and the way to improve performance still further lies in the use of MOSFETS or other field effect transistors, as shown in FIG. 2. The gate current in these devices is essentially zero and we attain ideal performance with $I_D$ always equal to $I_{D0}$.

In FIG. 2, biasing voltages are established by a string of resistors, $R_4$ to $R_{14}$, connected in parallel to a set of MOSFETS, M1-M10. The standing current, $I_{D0}$, is set by the choice of resistor $R_{15}$ ($R_{16}$ being the anode load), noting that the potential at (b) is the same as that at (a) except for the potential drop across the gate to source of the first MOSFET. Choosing $R_4$ to $R_{14}$ equal to 10 MΩ each and $R_{15}$=1 MΩ we have $I_{DV}$=10 μA and $I_{D0}$=100 μA for V=1100 volts. The actual currents depend only on the magnitude of the HV. Referring to (3) we now have $$I_{HV}=I_{D0}+I_a+I_{DV} \tag{4}$$

The current, $I_{D0}+I_a+I_{DV}$ that flows from the power supply must also flow into the ground connection at the other end of the divider. It is this realisation that leads to the opportunity for monitoring the anode signal at the photocathode end of the photomultiplier, free from the high voltage bias. The circuit of FIG. 2 is suitable for this purpose provided certain conditions are met.

Normally the resistor and transistor strings terminate at the cathode, but here, in order to implement this embodiment of the invention, the transistor string is connected to the inverting (−) input 16 of an operational amplifier 14, provided with a feedback resistor $R_2$ from its output to that input. The non-inverting (+) input 18 of the amplifier 14 is connected to the end of the resistor string, and to ground via resistor $R_1$ FIG. 2 shows the incremental currents in the active divider $M_1$-$M_{10}$ for which $I_D$ is constant (ie. $I_D=I_{D0}$) and independent of $I_a$. $I_{DV}$ is the constant current flowing in the resistor string $R_4$ to $R_{14}$ and including $R_1$; this establishes the required divider voltages. The active divider operates in the source follower mode and maintains the dynodes at fixed voltages.

The current leaving the transistor string is $I_D+I_a-I_K$, which when the cathode current $I_K$ is added-back means that the current in resistor $R_3$ is $I_D+I_a$.

It is characteristic of the operational amplifier that no current flows into either of its inputs 16, 18, from which it follows that the current to ground in resistor $R_1$ is $I_{DV}$, and the current in feedback resistor $R_2$ is $-(I_D+I_a)$. Thus a total current of $I_{D0}+I_a+I_{DV}$ flows to ground, either directly via $R_1$ or via the virtual ground provided by the operational amplifier.

The output of the amplifier is the difference between the voltages applied to its inputs and is therefore $$V_0=-(I_D+I_a)R_2+I_{DV}R_1 \quad (5)$$

and if we choose $R_1$ and $R_2$ such that $I_DR_2=I_{DV}R_1$ then the contributions to $V_0$ from the two biasing currents are equal but opposite and $$V_0=-I_aR_2 \quad (6)$$

Thus the standing current $I_D$ in the active arm of the voltage divider is effectively subtracted from the summed dynode currents, leaving $I_a$ accessible for measurement at near-ground potential. The output of amplifier 14 is a dc voltage $V_0$, which is representative of the anode current $I_a$, which is in turn a measure of photons sensed by the cathode 10.

The analysis so far refers to dc operation but it is important to recognise that a dc signal current is made up of individual, fast, single-electron pulses. A pulsed signal, such as that produced by a NaI(Tl) or other inorganic scintillator, may comprise up to ten thousand photoelectrons spread over a time of 20 to 3000 ns, depending on the type of scintillator and the source of radiation that is detected. The active divider must be capable of transmitting these fast signals to the operational amplifier. Insofar as the signals flowing into the dynodes are concerned, the MOSFETS are operating in the grounded gate configuration, which is essentially fast in its response (the manufacturer data quotes a rise time of 8 ns and a fall time of 16 ns for the ZVP1320F MOSFET used). Hence, it is desirable to provide a fast-track path.

Figure 3:
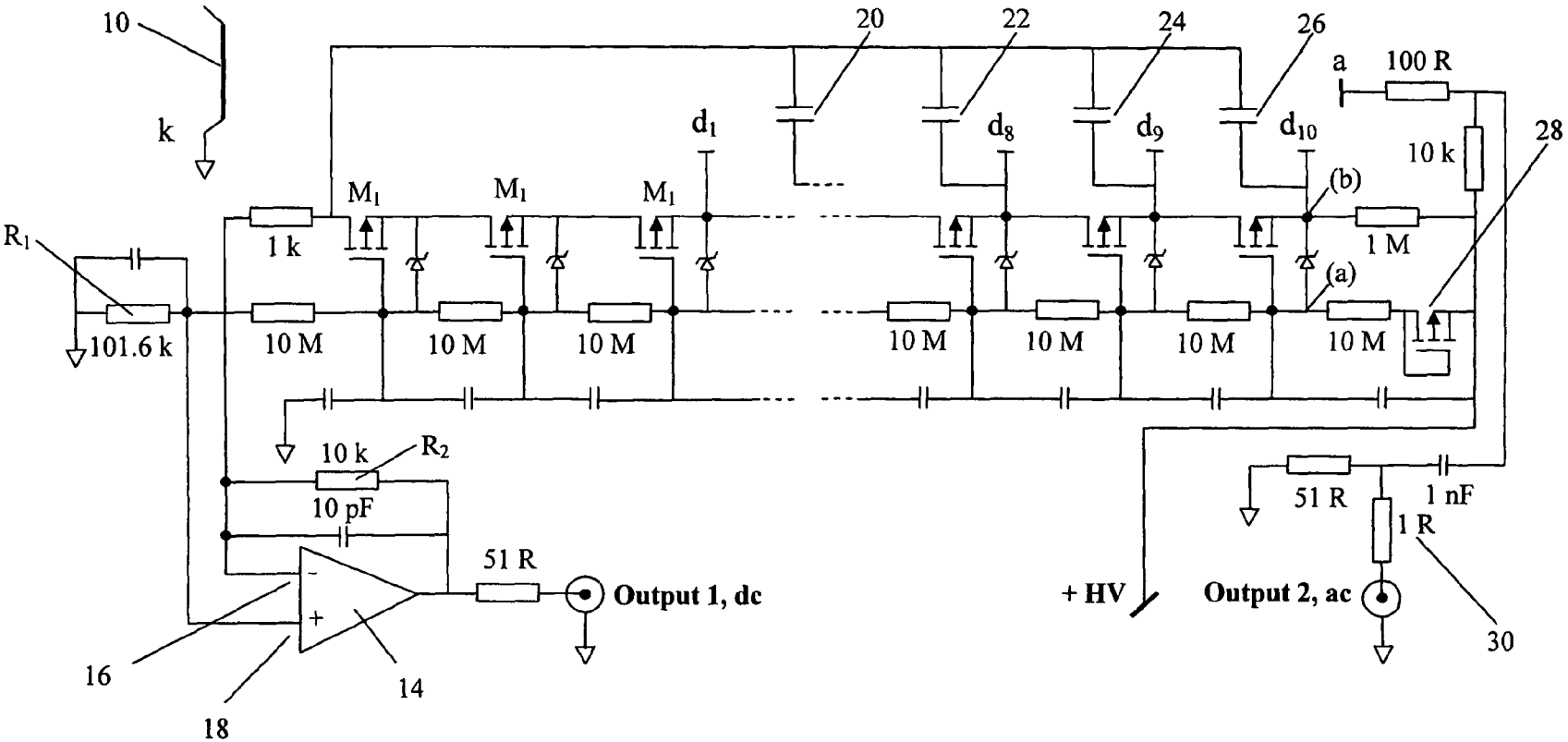
FIG. 3 is a more detailed and modified version of FIG. 2.

FIG. 3 shows a circuit which, when realised with the component values shown, can provide a practical embodiment of the invention. All capacitors are 10 nF unless otherwise indicated. Thus dynodes $d_7$ (not shown) $d_8$, $d_9$, $d_{10}$ are provided with a fast-track path via 10 nF capacitors 20, 22, 24 and 26 to the low-potential end of the MOSFET string. It is sufficient to couple only the last four stages of the divider, because the proportion of $I_a$ contributed by the more upstream stages is comparatively very small. As known per se, the most upstream dynode $d_1$ is biased from the cathode 10 at a more substantial voltage. This can enhance the speed of response or collection efficiency of the PMT. Also, because each MOSFET (here type ZVP1320F) can handle only a limited voltage (200 V for the ZVP1320F) more than one FET is needed to achieve the required biasing voltage for dynode $d_1$. Thus in FIG. 3 the $d_1$ biasing voltage is provided by three MOSFETS $M_1$ and three associated resistors of the resistor string.

The MOSFETS are protected with zener diodes BZX84C12L, which are normally inactive. The high zener diode capacitance of up to 100 pF, together with the MOSFET inter-electrode capacitance of up to 50 pF, can transmit sufficient signal to upset the biasing voltages of the resistor string and hence a 10 nF decoupling capacitor is provided across each resistor of the string.

The cathode current $I_K$, in FIG. 3, is not summed with the dynode currents but it is taken directly to ground. The summed current is thus $I_a-I_k$, which is essentially $I_a$, since in most applications the anode current is many orders of magnitude larger than the cathode current.

The operational amplifier is a TLV271ID. The feedback loop around it consists of a 10KΩ resistor ($R_2$ in FIGS. 2 and 3) in parallel with a 10 pF capacitor. Resistor $R_1$ is set at 101.6KΩ to satisfy and achieve the equality in equation (6). The amplifier when so configured has a time constant of 0.1 microsecond. Due to the capacitive feedback, it operates in the charge sensitive mode and performs the same function as the type of preamplifier recommended for NaI(Tl) spectroscopy, for example. Thus, it converts the signal charge pulse to a voltage pulse, or an anode current to a proportional voltage signal. The amplifier also disentangles the measured signal from the standing current, and it provides a voltage output as is required by most commercial electronic instrumentation.

A diode-configured MOSFET 28 is included at the HV end of the resistor string to provide temperature compensation and to ensure that the potentials at points (a) and (b) in FIG. 3 are closely matched. Whilst this is not essential it is a convenient enhancement of the circuit.

The circuit also includes a conventional capacitive pick-off, 30, for pulsed anode signals. The configuration shown, terminating in output 2 ac, is matched for 50 ohm coaxial cable transmission.

Figure 4:
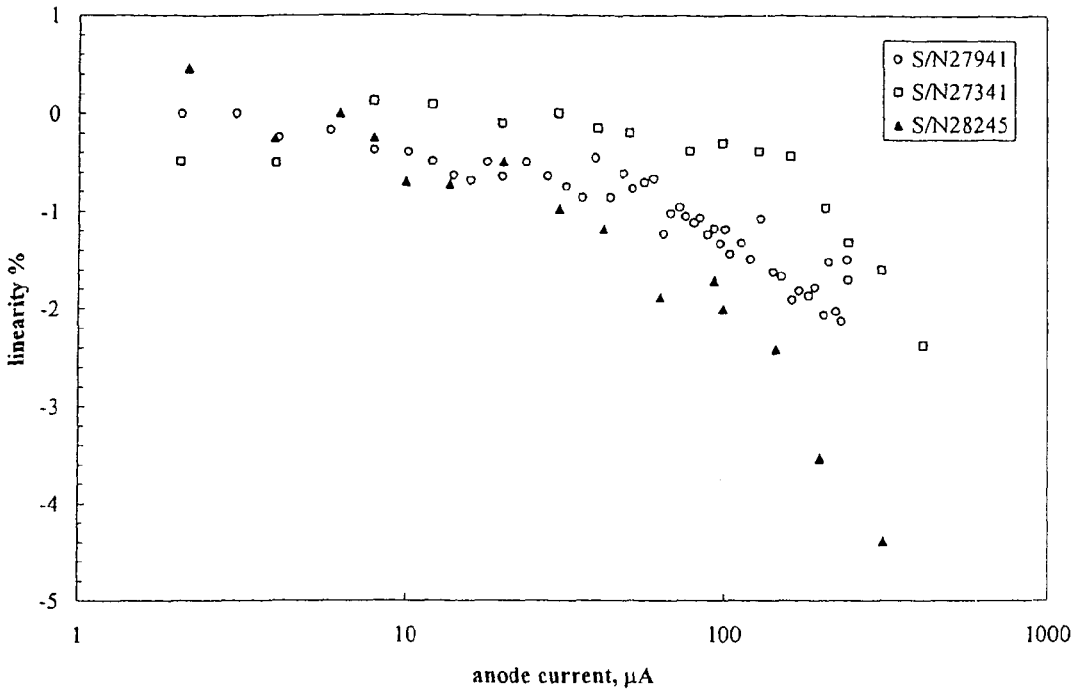
FIGS. 4, 5, 6 and 7 illustrate experimental results obtained with a circuit of the invention.
Figure 5:
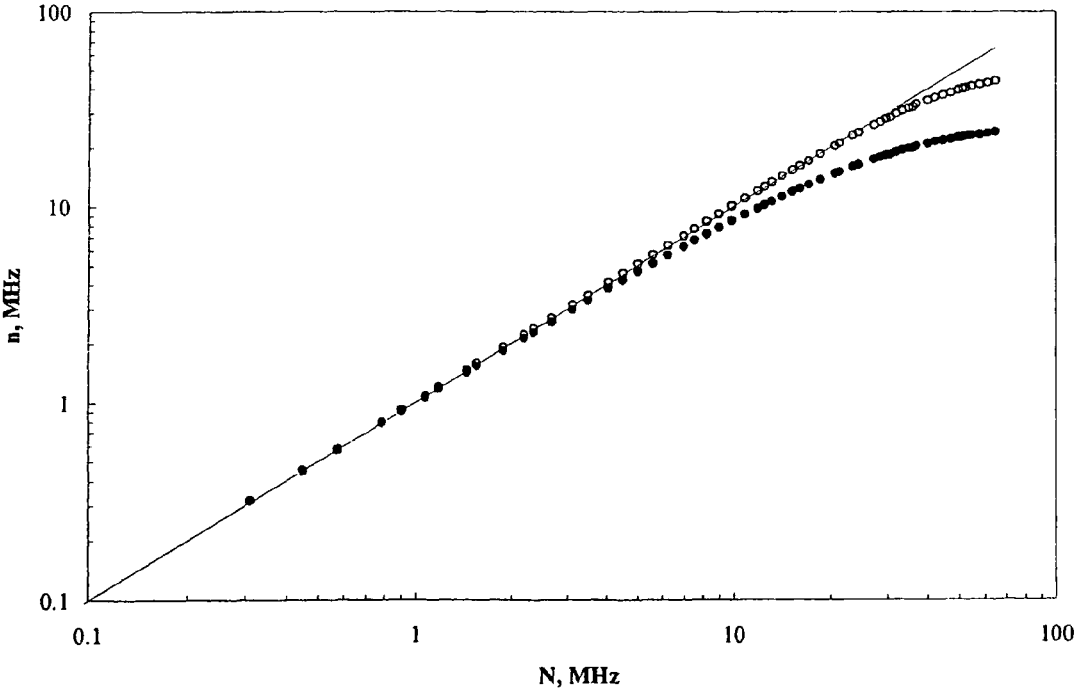

The performance of a circuit as shown in FIG. 3 but without the capacitors 20, 22, 24 and 26 was tested, and the results are illustrated in FIGS. 4 and 5.

Linearity of dc Signals

FIG. 4 shows the deviation from linear amplification as a function of anode current. The abscissa is expressed as anode current although the measured parameter is actually the output voltage of the operational amplifier 14. This is to emphasize that it is the magnitude of the mean anode current that determines the degree of non-linearity.

By non-linearity we mean any deviation in the linearity of the relationship between the anode signal current and the cathode signal current. In assessing photomultiplier non-linearity, by experimentation, there is always difficulty and uncertainty in measuring cathode currents of the order of pA. This may be circumvented by using two light sources, A and B, which can be switched on individually or in coincidence. If the anode signals are f(A) and f(B) respectively and f(A+B) is the signal when both are applied, then the linearity is defined as:

$$\text{linearity}=[\{f(A)+f(B)\}]-f(A+B)]/(f(A)+f(B)) \quad (7)$$

If (f(A)+f(B))>f(A+B) then the linearity is taken as negative since we get an output which is less than expected, and vice versa.

The performance of the circuit with three nominally-identical 25 mm photomultipliers is shown in FIG. 4, from which it can be deduced that linear performance to within 1% can be achieved for anode currents of up to ~100 μA. The scatter in adjacent readings, relating to the same PMT, suggests an uncertainty of measurement of ±½%. The curves for the individual photomultipliers follow different paths for anode currents beyond 100 μA which indicates that perhaps half the nonlinearity beyond this current level is dependent on variations between PMTs.

Photon Counting Performance

FIG. 5 shows the relationship between true photon counts, N, and the anode signal pulse frequency, n, as measured at output 2 of FIG. 3.

In this series of measurements single photon counts above a fixed threshold (output 2) and the corresponding anode currents (output 1) were recorded for comparison. The counts were measured by connecting a fixed threshold discriminator, an ETEL Limited type AD6 to output 2 of the FIG. 3 circuit. The AD6 has a threshold of −2 mV and a dead-time τ of 19 ns, assumed to be non-paralysable. The measured counts, n, and actual counts N are related by $$N=n/(1-n\tau) \quad (8)$$

At low counts, where the dead-time correction is negligible, we can establish a linear relationship between N and the amplifier output voltage and this is the basis for the straight line shown in FIG. 5. The solid dots represent the counts from output 2 and the open circles the corrected counts in accordance with (8). A true count rate of 30 MHz corresponds to an anode current of 50 μA, where dc linear performance (FIG. 4) has already been demonstrated. The actual counts when corrected, follow a linear relationship up to count rates of 30 MHz. The correction fails at counts exceeding 30 MHz, due to high frequency counting limitations of the discriminator, and not the photomultiplier, nor the operational amplifier.

Performance with NaI(TI) Scintillator Assemblies

NaI(TI) scintillators find wide application in nuclear radiation identification and monitoring. Detectors offered by manufacturers are usually in the form of an in-line assembly, consisting of a cylindrical NaI(TI) crystal mounted in optical contact with a PMT. The crystal is fixed to the window of the PMT and the whole contained within a metal enclosure. The enclosure is always operated at ground potential, for the safety and stability reasons already stated, with the necessity of a capacitively coupled anode signal. The present invention, if incorporated in such assemblies, removes the need for capacitive coupling and its attendant base line shift at high event rates (also known as rate effect).

Figure 6:
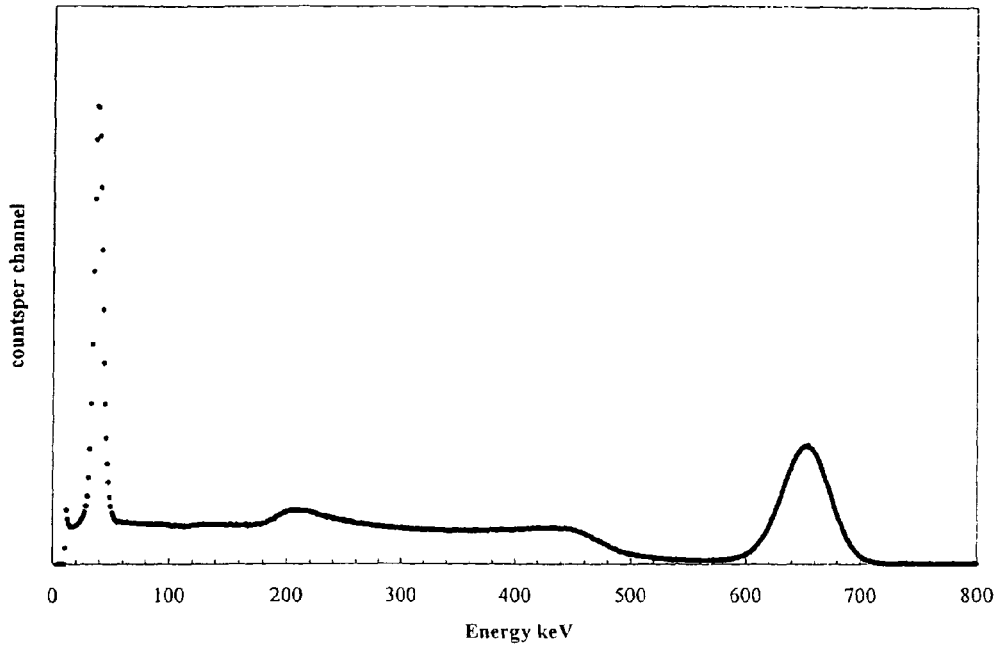
Figure 7:
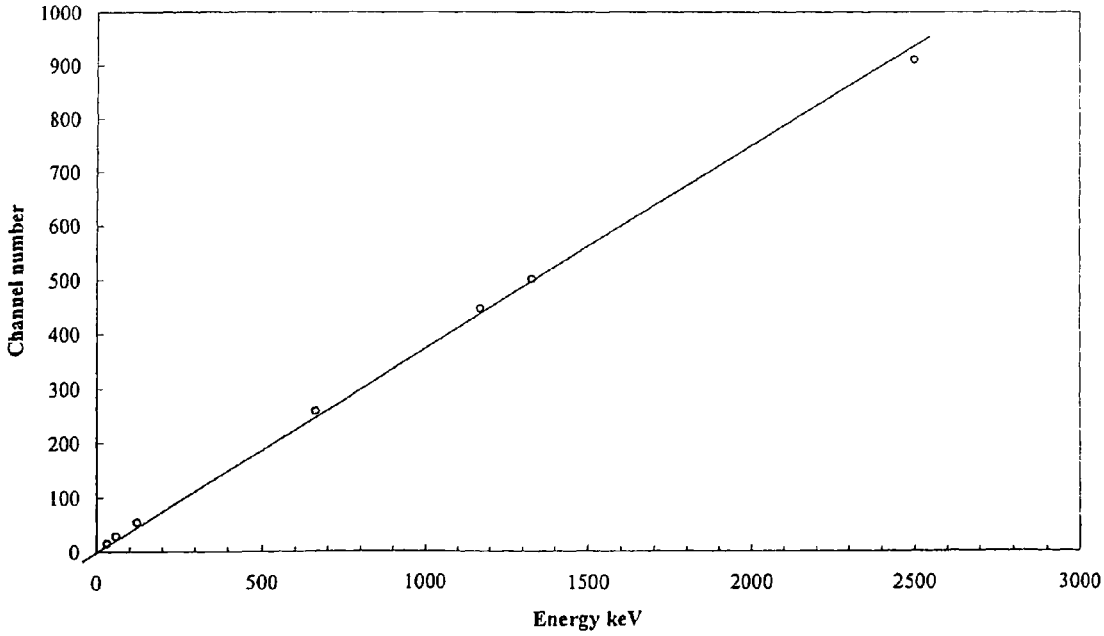

The circuit was tested with a 25 mm×25 mm (1"×1") Na(TI) crystal, a Canberra Multiport II multichannel analyser, and a $^{137}$CS source producing the distribution of FIG. 6, with the characteristic low-energy x-ray peak at 33 KeV. For this test, and that of FIG. 7, the coupling capacitors 20-26 had been fitted, and the circuit was as shown in FIG. 3. Linearity of performance was also verified using a set of isotopes, of energies from 36 KeV to 2500 KeV, with the results shown in FIG. 7. The absence of base line shift with rate was verified up to count rates of 100 KHz by viewing the output on an oscilloscope.

The circuit as tested was not optimal for all applications: components were chosen specifically for verification of the predicted performance parameters with reference to FIGS. 4 to 7. Modifications are possible for specific applications, for example as follows:

Choice of Divider Current.

There is an advantage in reducing the divider current when the equipment is to be powered by a battery. The standing current through the MOSFET string in the tested circuit was set to ~100 μA in order to improve the high frequency response of the MOSFET devices but it could be set to as low as 10 μA for dc applications. It is speculated that the 10 nF capacitors 20, 22, 24 and 26 shown in FIG. 3, which were added after the photon counting and dc investigations of FIGS. 4 and 5, may mitigate the need for high frequency FETs, since fast signals are transmitted via the capacitors in preference to through the FETS.

Photocathode Connection.

The photocathode 10 is taken directly to ground in FIG. 3 rather than to the 1 KΩ input resistor of the operational amplifier. This avoids having a small positive bias on the photocathode. We believe operation will still be stable if the bias remains below a few volts and it is likely that performance will be unaffected by a different cathode connection. The independent connection of the cathode provides flexibility in realising the best earthing arrangement for avoiding earth loops.

Choice of Operational Amplifier.

According to the manufacturer's data sheet, the TLV271ID opamp is not particularly fast with a bandwidth of 3 MHz but it has low offset of typically 0.5 mV (7 mV max). For applications involving scintillators faster than NaI(TI), such as YAP(Ce) and the plastics, it would be desirable to choose an amplifier with higher bandwidth.

Response to Ultra-Fast pmt Pulses.

This aspect of performance has not been investigated, but the output pulse rise time of the composite anode signal must be degraded because of the different delays suffered by each dynode current in reaching the amplifier input. The fast feedback track, via the capacitors 20, 22, 24 and 26 may compensate for this. Alternatively, only the signal from the last dynode could be fast-tracked and those from $d_9$, $d_8$ and $d_7$ decoupled directly to ground.

Simultaneous Recording of Counts and Current.

The theoretical and practical case for using the photon counting technique at low light levels is well established. At medium and high light levels, say in excess of 10 MHz, the unreliability associated with correcting readings for dead-time adds uncertainty, the magnitude of which increases with the count rate (see FIG. 5). Using anode current as the measure of high light levels is preferred, since there is no dead-time correction involved. The present invention allows for simultaneous recording of counts and current at outputs 2 and 1 respectively and the user can always relate a specific anode current to the true counts, as was done in FIG. 5. A choice as to which parameter to use is at the discretion of the user. In the present work, counts were measured at the anode. However, the output of the operational amplifier could be divided into two parallel channels, one of which would include a discriminator and the other a dc voltage measuring circuit. In this case output 2 could be omitted. The operational amplifier would need to be sufficiently fast to reproduce the single photoelectron signals without imposing excessive dead-time, but otherwise there are no additional demands on the circuitry.

The described embodiments of the invention can provide:

- good operational stability
- safety through operating both the crystal and the electronics at ground potential
- freedom from rate effects
- natural overlap of photon counting and electrometer modes of operation Each feature disclosed in this specification (which term includes the claims) and/or shown in the drawings may be incorporated in the invention independently of other disclosed and/or illustrated features. In particular but without limitation the features of any of the claims dependent from a particular independent claim may be introduced into that independent claim in any combination.

Statements in this specification of the "objects of the invention" relate to preferred embodiments of the invention, but not necessarily to all embodiments of the invention falling within the claims.

The text of the abstract filed herewith is repeated here as part of the specification.

A method of measuring an anode current in an electron-multiplier device having an anode, a cathode, dynodes and a voltage divider network for applying voltages to the dynodes, comprising applying a positive HV voltage to the anode and intermediate voltages to the dynodes, the cathode being at or near circuit ground potential, conducting dynode currents through or in parallel to the voltage divider to a point substantially at cathode potential, and deriving from those currents a current representative of the anode current.

The invention claimed is:

1. A method of measuring an anode current in an electron multiplier device having a cathode at or near circuit ground potential, an anode at a relatively high positive potential, a series of discrete dynodes at successive intermediate potentials, and a voltage divider comprising a string of transistors connecting the dynodes to respective points in a resistor string of the voltage divider, the method comprising:

passing at least some of the dynode currents successively through the string of transistors;

summing currents flowing in the dynodes and optionally also a cathode current, and deriving the measured current from the summed currents; and subtracting from the summed dynode currents a standing current in the voltage divider to measure substantially at ground potential a current representative of the anode current and derived from current flowing in the dynodes, without taking a measurement of a current between the anode and the dynode adjacent to the anode.

2. A method according to claim 1, comprising diverting at least some of the dynode currents around the string of transistors which connect the voltage divider to the dynodes.

3. The method of claim 2, wherein the transistors are field-effect transistors.

4. The method of claim 1, wherein the transistors are field-effect transistors.

5. The method of claim 1, wherein subtracting from the summed dynode currents a standing current in the voltage divider is to measure only substantially at ground potential a current representative of the anode current and derived from current flowing in the dynodes.

6. A biasing and measurement circuit for an electron multiplier having a cathode, an anode and a series of discrete dynodes therebetween, the circuit comprising a maintainer to maintain the cathode at or near circuit ground potential, a connector to connect the anode to a relatively high positive potential, a voltage divider comprising a string of transistors connecting the dynodes to respective points in a resistor string of the voltage divider to apply graduated intermediate voltages to the dynodes, and a measurer to measure substantially at ground potential a current representative of the anode current and derived from currents flowing in the dynodes, without taking a measurement of a current between the anode and the dynode adjacent to the anode;

wherein the measurer is configured to sum the currents flowing in all of the dynodes and optionally also a cathode current; and the measurer comprises a subtractor to subtract from the summed dynode currents a standing current flowing in an active arm of the voltage divider.

7. A circuit according to claim 6, wherein the subtractor comprises an operational amplifier.

8. A circuit according to claim 7, wherein the operational amplifier is provided with a feedback loop to its inverting input of impedance R2, the non-inverting input being grounded via an impedance R1 such that IDR2=IDVR1 where IDV is the standing current through the resistor string of the voltage divider and ID is the standing current through the string of transistors.

9. A circuit according to claim 8, wherein the transistors are field-effect transistors and comprising a director to direct at least some of the dynode currents through the source-drain paths of the field-effect transistors.

10. A circuit according to claim 9, wherein the diverter comprises a coupling capacitor.

11. A circuit according to claim 6 comprising a diverter to divert a current from at least one dynode around the voltage divider.

12. The biasing and measurement circuit of claim 6, wherein the measurer measures only substantially at ground potential.

13. An electron multiplier comprising a biasing and measurement circuit having a cathode, an anode and a series of discrete dynodes therebetween, the circuit comprising a maintainer to maintain the cathode at or near circuit ground potential, a connector to connect the anode to a relatively high positive potential, a voltage divider comprising a string of transistors connecting the dynodes to respective points in a resistor string of the voltage divider to apply graduated intermediate voltages to the dynodes, and a measurer to measure substantially at ground potential a current representative of the anode current and derived from currents flowing in the dynodes, without taking a measurement of a current between the anode and the dynode adjacent to the anode;

wherein the measurer is configured to sum the currents flowing in all of the dynodes and optionally also a cathode current; and the measurer comprises a subtractor to subtract from the summed dynode currents a standing current flowing in an active arm of the voltage divider.

14. An electron multiplier according to claim 13, wherein the electron multiplier is a photomultiplier.

15. The electron multiplier of claim 13, wherein the measurer measures only at substantially ground potential.

16. A biasing and measurement circuit for an electron multiplier having a cathode, an anode and a series of discrete dynodes therebetween, the circuit comprising means for maintaining the cathode at or near circuit ground potential, means for connecting the anode to a relatively high positive potential, a voltage divider comprising a string of transistors connecting the dynodes to respective points in a resistor string of the voltage divider for applying graduated intermediate voltages to the dynodes, and means for measuring substantially at ground potential a current representative of the anode current and derived from currents flowing in the dynodes, without taking a measurement of a current between the anode and the dynode adjacent to the anode;

wherein the measuring means is configured to sum the currents flowing in all of the dynodes and optionally also a cathode current; and the measuring comprises a subtractor to subtract from the summed dynode currents a standing current flowing in an active arm of the voltage divider.

17. The biasing and measurement circuit of claim 16, wherein the means for measuring substantially at ground potential measures only at substantially ground potential.

* * * * *